US005533292A

United States Patent [19]

Swan

[11] Patent Number: 5,533,292

[45] Date of Patent: Jul. 9, 1996

[54] SELF-ALIGNING FLIP-UP SIGHT

[76] Inventor: Richard E. Swan, 171 West St., East Bridgewater, Mass. 02333

[21] Appl. No.: 214,448

[22] Filed: Mar. 18, 1994

[51] Int. Cl.[6] ..... F41G 1/08; F41G 1/14

[52] U.S. Cl. ..... 42/100; 33/255; 33/260; 33/241

[58] Field of Search ..... 42/100, 103; 33/253, 33/260, 241, 255, 259, 251

[56] References Cited

U.S. PATENT DOCUMENTS

| | | | |
|---|---|---|---|
| 878,857 | 2/1908 | Bevier | 33/255 |
| 4,597,211 | 7/1986 | Miles | 42/100 |
| 4,665,622 | 5/1987 | Idan | 33/241 |

FOREIGN PATENT DOCUMENTS

| | | | |
|---|---|---|---|
| 151669 | 6/1904 | Germany | 33/255 |
| 1272 | 10/1906 | United Kingdom | 33/255 |
| 169397 | 9/1921 | United Kingdom | 33/255 |

*Primary Examiner*—Stephen M. Johnson
*Attorney, Agent, or Firm*—John P. McGonagle

[57] ABSTRACT

A self-aligning flip-up mechanism for aiming devices for use with firearms. The mechanism folds the aiming device into the contour of the firearm during non-use. The mechanism is spring-loaded and flips into a vertical operational position with a simple movement of a finger or thumb. The mechanism causes the aiming device to self-align itself as it moves into an operational position. Vertical position repeatability is assured by the location of alignment surfaces in the sight which come into contact with alignment chamfers.

18 Claims, 11 Drawing Sheets

SELF-ALIGNING FLIP-UP SIGHT

BACKGROUND OF THE INVENTION

The present invention relates generally to the field of firearms sighting devices, and more particularly to a self-aligning mechanism for sighting devices which protrudes from the firearm when being used and folds down into the firearm's general contour when not in use.

Sighting mechanisms for firearms, such as rifles, shotguns and handguns, are generally bulky and protrude outside the firearm's general contour. This creates a greater opportunity for the sighting mechanism to be caught on clothing or brush when carried and knocked out of alignment from this contact or contact with other solid objects. Prior art devices which address this problem require re-alignment of the sighting mechanism before each use. Although this may be acceptable in a controlled environment such as a gun range, or the like, it is not acceptable during "field use," such as hunting or combat environments where immediate, fully aligned use of the sight is required.

Field use requires a sighting mechanism that is located out of the way, i.e., within the firearm's general contour, during times of non-use, thereby providing a stream-lined profile, yet quickly engageable for times of immediate use or need. The readiness time for the sighting mechanism to move from the non-use or down position to the use or up position must be minimized. The sighting mechanism must have the ability to be consistently and quickly engaged, and provide accurate aiming.

SUMMARY OF THE INVENTION

In view of the foregoing disadvantages inherent in the known types of devices now present in the prior art and the requirements for sighting devices in field use, the present invention provides an improved method of compacting and activating optical and iron sight sighting device. As such, the general purpose of the present invention, which will be described subsequently in greater detail, is to provide a new and improved engagement method for firearms sighting devices which has the ability to consistently and quickly engage, and provide accurate aiming, while not interfering with other ancillary aiming devices and attachments.

To attain this, the present invention provides a self-aligning flip-up sight. The present invention sighting device folds against a receiver sleeve mounting area or other desirable location, thereby keeping the sighting device within the firearm's contour during non-use and streamlining the profile of a weapon. The sighting device is spring-loaded and flips into an operational position with a simple movement of a finger or thumb. The present invention sighting device self-aligns itself as it moves into an operational position, thereby providing accurate and consistent aiming.

The present invention self-aligning, flip-up sight consists of a sighting mechanism mounted on the rear of a receiver top section or elsewhere that provides optimum usage. The sighting mechanism is restrained against the rear of the receiver sleeve by a simple clamp until needed. Upon need, the clamp is finger-rotated. A torsional spring then causes the sighting mechanism, to flip-up into a vertical aiming position. This vertical position is assured repeatability by the location of alignment surfaces in the sighting mechanism which come into contact with alignment chamfers. Thus the sighting mechanisms of the instant invention can be carried in a down position until needed, and then can quickly and accurately be released into a repeatable up position where they can be used to sight in a target.

The invention allows two basic types of sighting devices, i.e., "iron" sights and compact single optic frames with lens projected beam optics, to fold into a down position and be engaged in battery for repeat accurate alignment. The invention also addresses the rigid but fragile single frame optics' proneness to damage from external forces by including brush deflectors and a fold and protect capability not normally required for iron sights to this extent.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated preferred embodiments of the invention.

DETAILED DESCRIPTION OF THE INVENTION

Figure 1:
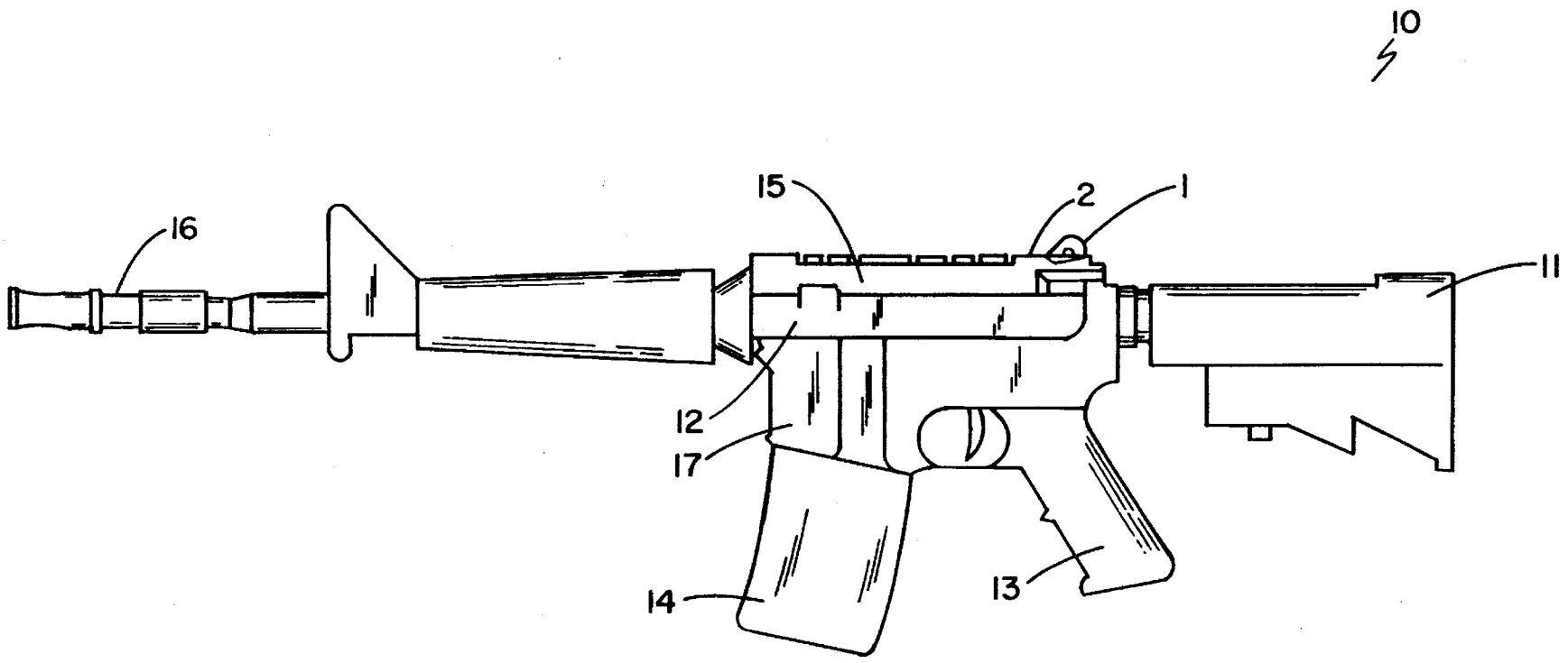
FIG. 1 is a side elevational view of a combat rifle with a Swan universal receiver sleeve mounted thereon.

Referring to the drawings in detail wherein like elements are indicated by like numerals, there is shown in FIG. 1 a left side elevational view of a conventional combat firearm 10 having a stock 11, upper receiver 12, lower receiver 17, barrel 16, pistol grip 13 and magazine 14. This firearm 10 has a Swan universal receiver sleeve 2, as disclosed in U.S. Pat. No. 5,142,806, dated Sep. 1, 1992, mounted on the top 15 of the upper receiver 12. U.S. Pat. No. 5,142,806 is incorporated herein by reference.

For purposes of exposition, the longitudinal axis of the firearm 10 is defined as extending from the stock 11 through the barrel 16. The firearm longitudinal axis will be considered to be in a horizontal plane. The vertical axis will be considered from the magazine 14 and/or grip 13 through the lower receiver 17 and to the upper receiver 12, with "up" being in the direction of the upper receiver 12 and "down" being in the direction of the magazine 14 and/or grip 13. Rearward will refer to a direction toward the stock 11 and forward will refer to a direction toward the barrel 16. Right and left sides are determined looking from the stock 11 toward the barrel 16.

The invention 1 is a self-aligning flip-up sight for firearms and is comprised of three major components: a base 20, a U-shaped alignment member 50, and a sight housing 80. The sight housing 80 contains the actual aiming device. The invention 1 is designed to be mounted preferably on a Swan universal receiver sleeve 2, extended rigid frame receiver sleeve 3, or buffered attachment device 4 attached to the top 15 of a firearm upper receiver 12. However, the invention 1 may be used in place of or in conjunction with most firearm sighting mechanisms. In the following described embodiment, the invention 1 is described in conjunction with the sleeve 2.

Figure 5:
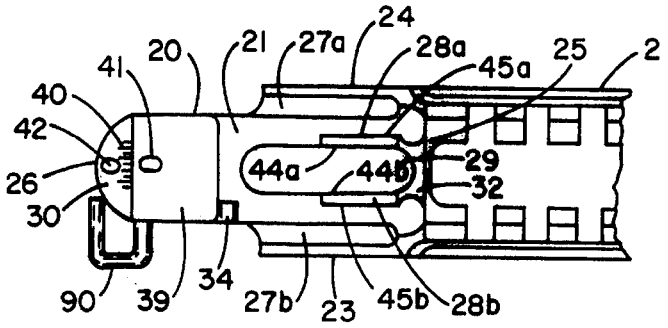
FIG. 5 is a top view of flip-up iron sight base at the rear of a Swan universal receiver sleeve.
Figure 6:
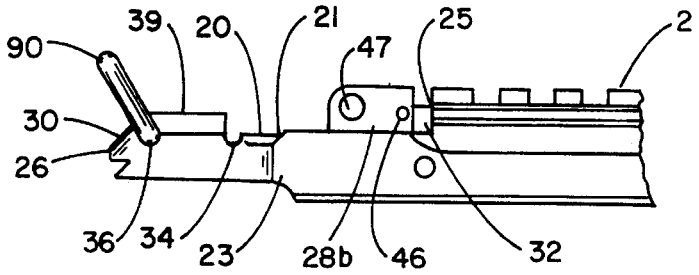
FIG. 6 is a side elevational view of the flip-up iron sight base shown in FIG. 5.
Figure 7:
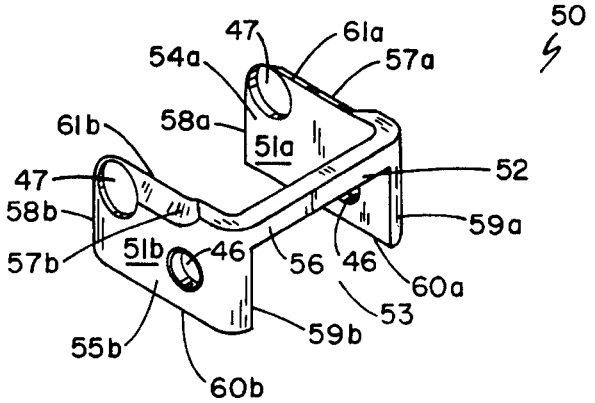
FIG. 7 is a right-front perspective view of the flip-up iron sight U-shaped alignment member.
Figure 8:
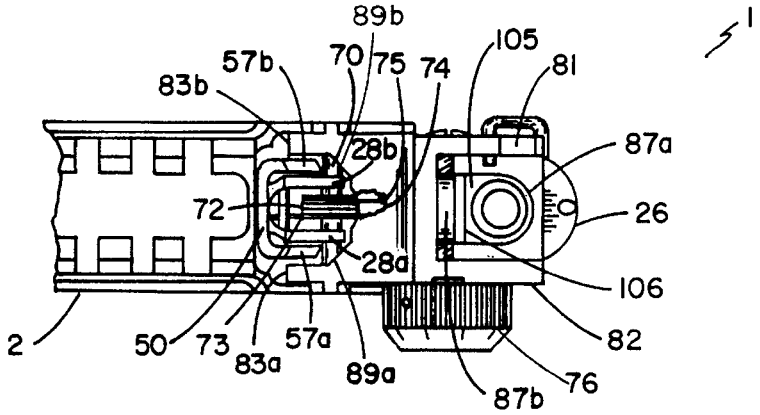
FIG. 8 is a top view of the flip-up iron sight shown in FIG. 2.
Figure 9:
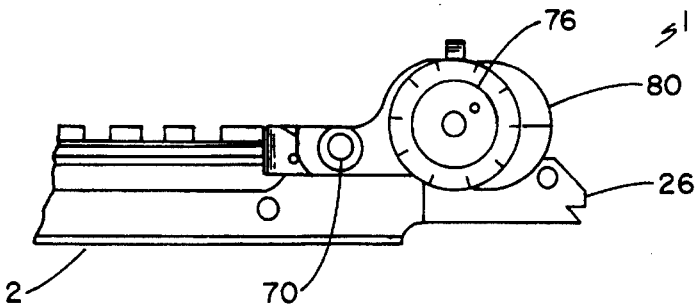
FIG. 9 is a left-side elevational view of the flip-up iron sight shown in FIG. 8.
Figure 10:
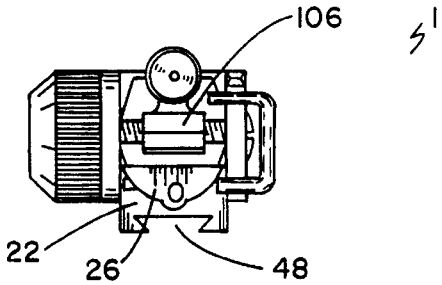
FIG. 10 is a rear elevational view of the flip-up iron sight shown in FIG. 9.
Figure 11:
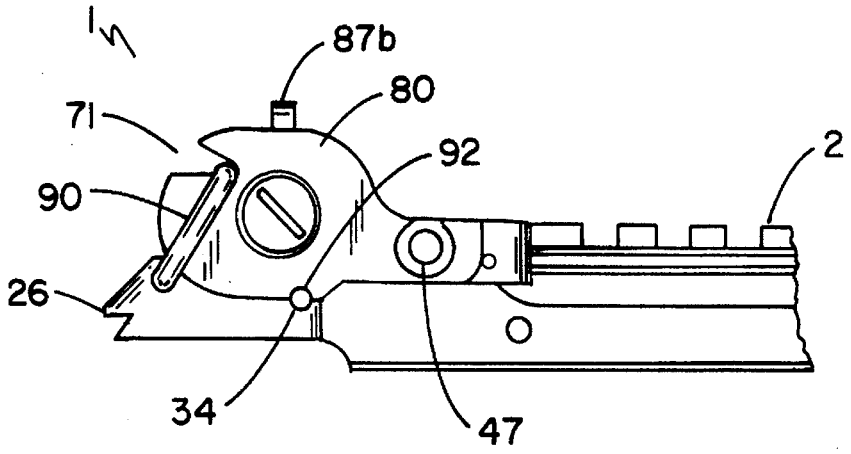
FIG. 11 is a right-side elevational view of the flip-up iron sight in the normally closed first position.
Figure 12:
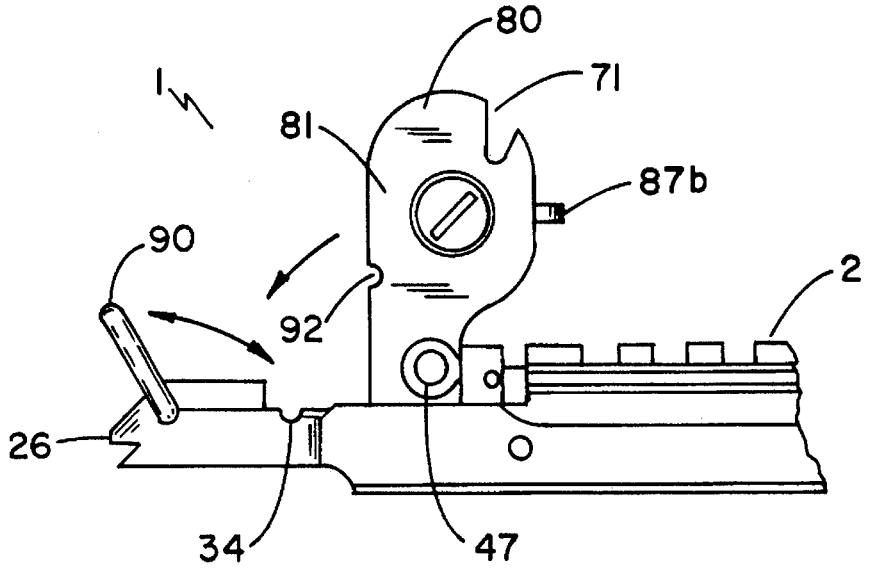
FIG. 12 is a right-side elevational view of the flip-up iron sight in the open second position.
Figure 13:
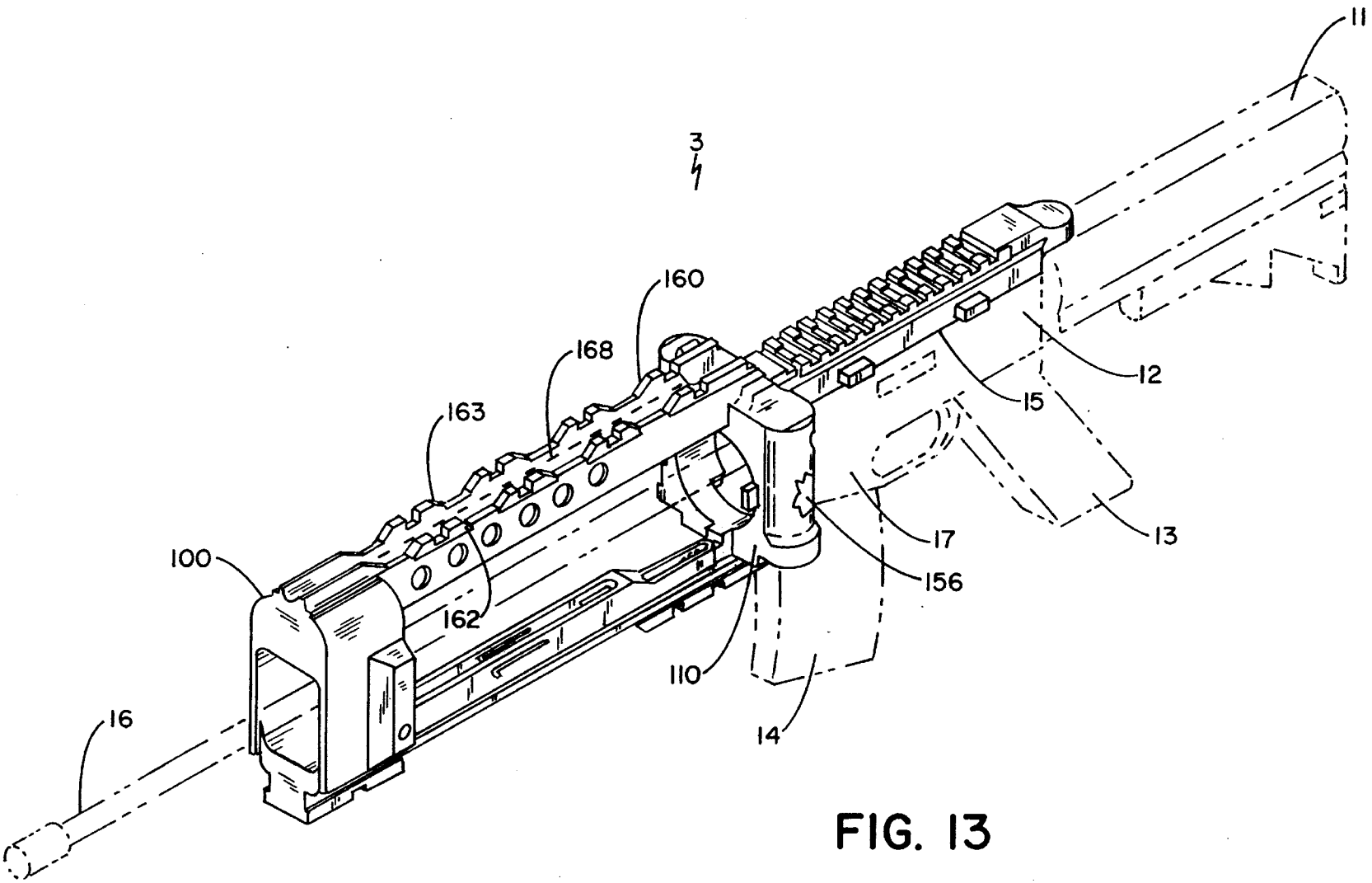
FIG. 13 is a front perspective view of the Swan extended rigid frame receiver sleeve mounted on a combat rifle.

As may be most clearly seen in FIGS. 5, 6 & 10, the base 20 is formed as part of and extending rearwardly from the universal receiver sleeve 2. The base 20 has a generally flat upper surface 21 and a lower surface 22 which has a cross-sectional profile identical to the cross-sectional profile of the receiver sleeve bottom 48. The base 20 has a right side 23, a left side 24, front 25 and rear 26. Two identical, vertical and parallel mounting tabs 28*a* and 28*b* extend perpendicularly upward from the base upper surface 21. The tabs 28*a*, 28*b* are thin, have a rectangular shape and lie in vertical parallel planes a predetermined distance apart. The tab planes are parallel to the base sides 23, 24. The tabs 28*a*, 28*b* begin nearly at the base front 25 and extend rearwardly approximately ¼ of the base longitudinal distance. A spring trough 29 is shaped into the base upper surface 21 between the tabs 28*a*, 28*b*. The width of the trough 29 is defined by the separation between the tabs 28*a*, 28*b*. The trough 29 begins at the base front 25 and extends rearwardly approximately ½ of the base longitudinal distance. The tabs 28*a*, 28*b* have symmetrical inner faces 44*a* and 44*b* in apposition with bottom inner edges terminating at the spring trough 29. The mounting tabs 28*a* and 28*b* also have symmetrical outer faces 45*a* and 45*b* terminating at the base upper surface 21. Two narrow alignment surfaces 27*a* and 27*b* are channeled into the base upper surface 21 between each mounting tab 28*a*, 28*b* and the adjacent base side 23, 24. The alignment surfaces 27*a* and 27*b* begin at the base front 25 and extend rearwardly approximately ½ of the base longitudinal distance. The outer face 45*a* of mounting tab 28*a* faces and is perpendicular to alignment surface 27*a* and the outer face 45*b* of the mounting tab 28*b* faces and is perpendicular to the alignment surface 27*b*. The mounting tabs 28*a*, 28*b* each have a spring pin hole 46 located in the their forward lower quadrants perpendicular to the inner faces 44*a*, 44*b* and outer faces 45*a*, 45*b* with a common center. The mounting tabs 28*a*, 28*b* also each have a rotational spring pin hole 47 located in the their rearward upper quadrants perpendicular to the inner faces 44*a*, 44*b* and outer faces 45*a*, 45*b* with a common center and parallel to the spring pin hole 46. The front 25 of the base, located against the rear edge of the receiver sleeve 2 and immediately forward, adjacent and between the tabs 28*a*, 28*b*, is raised forming an arc shaped section 32 with a vertical height equal to approximately ⅓ the vertical height of the tabs 28*a*, 28*b*.

Referring to the drawings, and particularly to FIGS. 2, 3, 4, 7 & 8, the U-shaped alignment member 50 has two vertical sides 51*a*, 51*b* and a front face 52 with a rectangular cutout 53. Each vertical side 51*a*, 51*b* has an inner surface 54*a*, 54*b*, outer surface 55*a*, 55*b*, rear 58*a*, 58*b*, front 59*a*, 59*b*, bottom 60*a*, 60*b* and top 61*a*, 61*b*. The inner surfaces 54*a*, 54*b*, are defined as the facing surfaces of the vertical sides 51*a*, 51*b*, respectively. The vertical sides have inner surfaces 54*a*, 54*b* are in apposition in parallel planes and the vertical sides' outer surfaces 55*a*, 55*b* the same predetermined distance from the inner faces 54*a*, 54*b*. The inner faces 54*a* and 54*b* and outer faces 55*a* and 55*b* are all parallel to one another. The vertical sides 51*a*, 51*b* also have a spring pin hole 46 located in the their forward lower quadrants perpendicular to the inner surfaces 54*a*, 54*b* and outer surfaces 55*a*, 55*b* with a common center. The vertical sides 51*a*, 51*b* also each have a rotational spring pin hole 47 located in their rearward upper quadrants perpendicular to the inner faces 54*a*, 54*b* and outer faces 55*a*, 55*b* with a common center and parallel to the spring pin hole 46. The spring pin hole 46 and rotational spring pin hole 47 of the U-shaped alignment member 50 are located such that they share common centers with the holes in the mounting tabs 28*a* and 28*b* and are parallel to one another. When the U-shaped alignment member inner faces 54*a* and 54*b* are affixed adjacent to the outer faces 45*a* and 45*b* of the mounting tabs 28*a* and 28*b*, the top portion 56 of the front cutout 53 rests nearly on the base front arc-shaped section 32. The U-shaped alignment member 50 is attached to the mounting tabs 28*a* and 28*b* by a spring pin 95 as installed through the common spring pin holes 46. Alternatively, other fasteners such as bolts or rivets could be used. The spring pin 95 is inserted through both vertical sides 51*a* and 51*b* of the U-shaped alignment member 50 and the mounting tabs 28*a* and 28*b* via the common center spring pin hole 46.

The sight housing 80 has two parallel plates, a catch plate 81 and an adjustment plate 82, positioned in vertical planes. The catch plate 81 terminates in a foot end 83*b* and the adjustment plate 82 terminates in a foot end 83*a*. The sight housing 80 is further defined by an upper aperture 84 between the catch plate 81 and the adjustment plate 82. The upper aperture 84 houses the invention aiming means. The aiming means is comprised of an L-shaped aiming element 105 with two ends and a center 106, said center 106 being mounted on a sight adjustment screw 85 positioned and attached between the catch plate 81 and the adjustment plate 82. The element 105 contains a circular aiming peep sight 87*a*, 87*b* on each end. An arced spring 86 is attached along the bottom of the upper aperture 84 transverse to the longitudinal axis of the base 20. The arced spring 86 applies pressure against the aiming element center 106 thereby allowing the element 105 to rotate approximately 90 degrees around the sight adjustment screw 85 and hold in position. A sight adjustment knob 76 is attached to one end of the sight adjustment screw 85 wherein the aiming element 105 is adapted to be moved across the sight adjustment screw 85 as the sight adjustment knob 76 is turned. The sight housing 80 is further defined by a lower aperture 88 which has an inside surface bounded by the catch plate 81, the adjustment plate 82, and alignment surfaces 89*a* and 89*b*, described in detail below.

In the invention open position, the sight housing lower aperture 88 is positioned over the outer faces 55*a* and 55*b* of the U-shaped alignment member 50 such that a rotational spring pin hole 47 in the sight housing 80 shares a common center with the rotational spring pin hole 47 in the alignment plates 51*a* and 51*b* of the U-shaped alignment member 50 and the rotational spring pin hole 47 in the mounting tabs 28*a* and 28*b*. A rotational spring pin 70 is then inserted into the rotational spring pin hole 47 attaching the sight housing 80, U-shaped alignment member 50 and the mounting tabs 28*a* and 28*b* together. The sight housing 80 is attached by the rotational spring pin 70 to the alignment plates 51*a* and 51*b* and the mounting tabs 28*a* and 28*b* such that the sight housing 80 can rotate about the rotational spring pin 70 a predetermined amount. The spring pin 70 affixes the inside faces 54*a* and 54*b* of the U-shaped alignment member 50 adjacent to the outside faces 45*a* and 45*b* of the mounting tabs 28*a* and 28*b* and the inside surfaces of the catch plate 81 and the adjustment plate 82 of the sight housing 80 to the outer faces 55*a* and 55*b* of the U-shaped member 50. Alternatively, other fasteners such as bolts or rivets could be used.

A finger release clamp 90 holds the sight housing 80 in a the closed position against the base 20. The finger release clamp 90 engages a pin catch slot 71 formed in the catch plate 81 thereby holding the sight housing 80 in a normally closed first position. The finger release clamp 90 is mounted in a pin bore 36 which is drilled into the base rear 26 perpendicular to the longitudinal axis of the sleeve 2. The base rear 26 has an arced face 30 sloping rearward from a stepped ledge 39 formed at the base rear 26 thereby creating a surface for index marks 40. A resistance spring 41 is mounted in a resistance bore 42 formed in the arced face 30 thereby providing resistive force against rotation of the finger release clamp 90. The resistance bore 42 is located parallel to the longitudinal axis of the sleeve 2, and drilled into the arced face 30. A half-cylindrical notch 34 is formed in the flat upper surface 21 just forward of the stepped ledge 39. The longitudinal axis of the notch 34 is transverse to the longitudinal axis of the base 20. The purpose of the notch 34 is to provide a place in the base for the clamp 90 to fold into, out of the way, when it is not holding the sight housing 80 in a down position. Another notch 92 is formed in the rear of the catch plate 81. The purpose of the this catch plate notch 92 is to avoid damage to the sight housing 80 if it gets knocked down with great force into the clamp 90 partially protruding from the base notch 34.

Rotating the finger release clamp 90 in a rearward direction disengages the finger release clamp 90 from the pin catch slot 71 and allows rotation of the sight housing 80 from the normally closed first position to the open second position. A torsional spring 72 urges the sight housing 80 from the closed first position to a vertical open second position. The torsional spring 72 surrounds the rotational spring pin 70 in the lower aperture 88 area between the foot ends 83*a* and 83*b*. One end 73 of the torsional spring 72 rests in the spring trough 29 and a second end 74 is located in a sight housing spring cavity 75. The spring cavity 75 is located perpendicular to the upper surface of the lower aperture 88. The first 73 and second 74 ends of the torsional spring 70 are located such that the sight housing 80 is urged in a forward direction to the same approximately vertical position around the rotational spring pin 70 when the finger release clamp 90 is disengaged from the pin catch slot 71.

Figure 2:
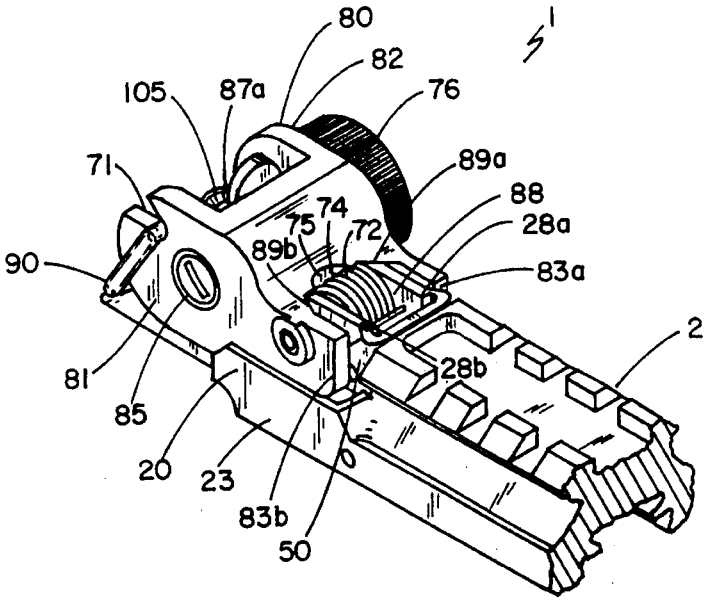
FIG. 2 is a right-front perspective view of the flip-up iron sight in the normally closed first position.
Figure 3:
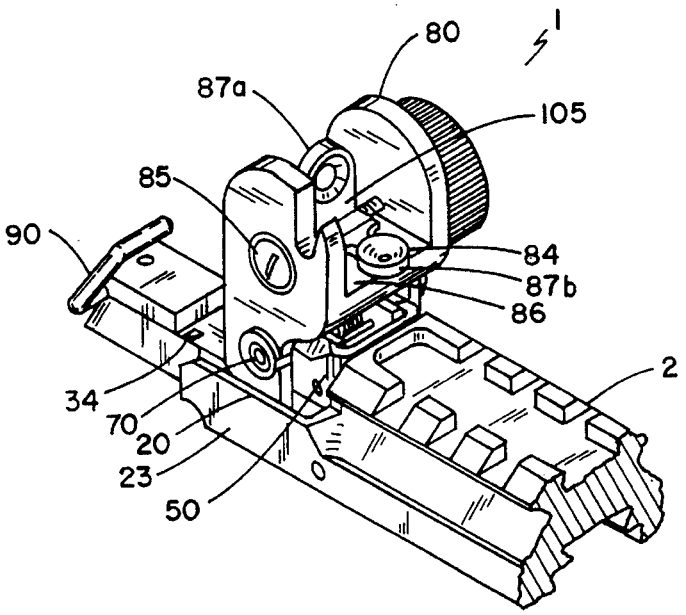
FIG. 3 is a right-front perspective view of the flip-up iron sight in the open second position.
Figure 4:
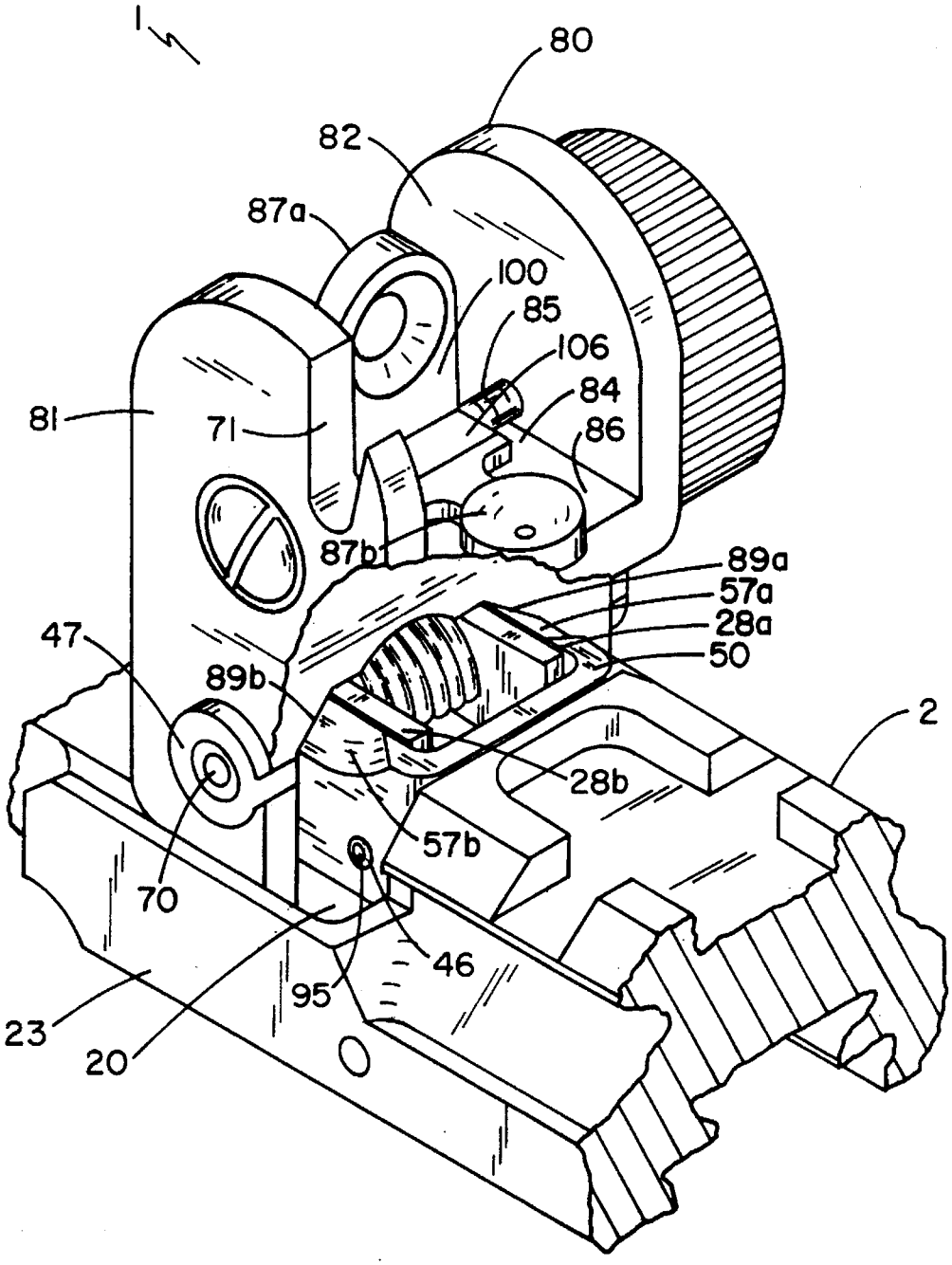
FIG. 4 is a close-up view of the flip-up iron sight shown in FIG. 3, partly in section.

Referring to the drawings in detail wherein like elements are indicated by like numerals, there is shown in FIG. 2 a perspective view of a self-aligning flip-up sight 1 in the normally closed first position, as configured at the rear of a universal receiver sleeve 2. This shows the relative position of a sight housing 80 as held in the closed first position by a finger release clamp 90. Also can be seen the rear adjustable aiming element 105, a sight adjustment screw 85, and a sight adjustment knob 76, which allows a user to compensate for wind adjustments when utilizing the sight 105. Turning the sight adjustment knob 76, the aiming element 105 is moved across the sight adjustment screw 85 providing a means for adjusting the aim. Alternatively, other sight adjustment mechanisms could be used.

CHAMFER SYSTEM

Consistent vertical positioning of the sight housing 80 is accomplished with the aid of alignment chamfers 57*a* and 57*b*, formed on the tops 61*a*, 61*b* of the U-shaped alignment member vertical sides 51*a*, 51*b*, just forward of the rotational spring holes 47 and extending nearly to the fronts 59*a*, 59*b*. The alignment chamfers 57*a* and 57*b* begin at the innersurface-top edges 54*a*–61*a*, 54*b*–61*b* and slope downward toward the outersurface-top edges 55*a*–61*a*, 55*b*–61*b*. In this embodiment of the invention, the chamfer slopes are at a forty-five degree angle and the longitudinal axis of the alignment chamfers 57*a*, 57*b* are parallel to the longitudinal axis of the base 20.

The sight housing 80 has corresponding alignment surfaces 89*a* and 89*b*. When the sight housing 80 is released to the open second position, the alignment surfaces 89*a* and 89*b* are wedged against the alignment chamfers 57*a*, 57*b*, respectively, bringing the sight housing 80 to rest in the same vertical position every time it is released. The alignment surfaces 89*a*, 89*b* in this embodiment have a forty-five degree upward slope from the catch and adjustment plates 81, 82. The slopes of the alignment surfaces 89*a*, 89*b* correspond to the slopes of the alignment chamfers 57*a*, 57*b*. Repeatability is further ensured by the "squeezing" action of the alignment surface 89*b* and catch plate 81 against the U-shaped alignment vertical side 51*b* toward the base mounting tab 28*b*, and the corresponding "squeezing" action of the alignment surface 89*a* and adjustment plate 82 against the U-shaped alignment vertical side 51*a* toward the base mounting tab 28*a*. This ensures repeated and accurate alignment of the U-shaped alignment member vertical sides 51*a*, 51*b* during each movement of the sight housing 80 to the open, second position.

The consistent vertical positioning of the sight housing 80 is also aided by the clearance of the adjustment plate foot end 83*a* and catch plate foot end 83*b* from the alignment recesses 27*a*, 27*b* when the sight housing 80 is released to the vertical open second position. Both the clearance of the foot ends 83*a*, 83*b* from the alignment recesses 27*a*, 27*b* and the chamfer system allow the self-aligning flip-up sight 80 to be carried in the normally closed first position streamlining the weapon profile. The self-aligning flip-up sight 1, only when needed, is released to a consistent open second position while providing instantaneous consistent accurate sighting, minimizing the possibility of the sighting mechanism being knocked out of alignment.

The above-described embodiment used a conventional firearm "iron" peep sight as the aiming device. However, the principles of the present invention are also applicable to the newer optics sights currently becoming available, i.e., compact single optic frames with lens projected beam optics. The newer optics sights have a radial axis parallel to the transverse plane of the weapon and a central axis parallel to the longitudinal axis of the weapon. The newer optics sights have aiming optics which are quite flat along their central axis. The sights focus energy from illumination means on the flat aiming optics. The illumination means may be a laser, or other directed energy illuminator which directs energy onto the aiming lens. The present invention permits, for the first time, an ability to fold down aiming optics when not in use, and provides an ability to flip up the aiming optics to a preset configuration for actual use. Problems with the aiming optics being caught on clothing or brush when carried and knocked out of alignment from this contact or contact with other solid objects, are thereby eliminated.

FIGS. 13 through 20 describe embodiments of the invention wherein the "iron" aiming element 105 of the above invention embodiment is replaced with an optics sight using flat aiming optics. However, the basic sight apparatus is the same whether or not an "iron" aiming element is used or an optics sight is used. To avoid redundancy, the "iron" aiming sight 105 was described in conjunction with the universal receiver sleeve 2; and the optics sight 5 will be described with the extended receiver sleeve 3 and buffered attachment device 4. Notwithstanding this expositions, the "iron" sight and optics sight are interchangeable.

Figure 19:
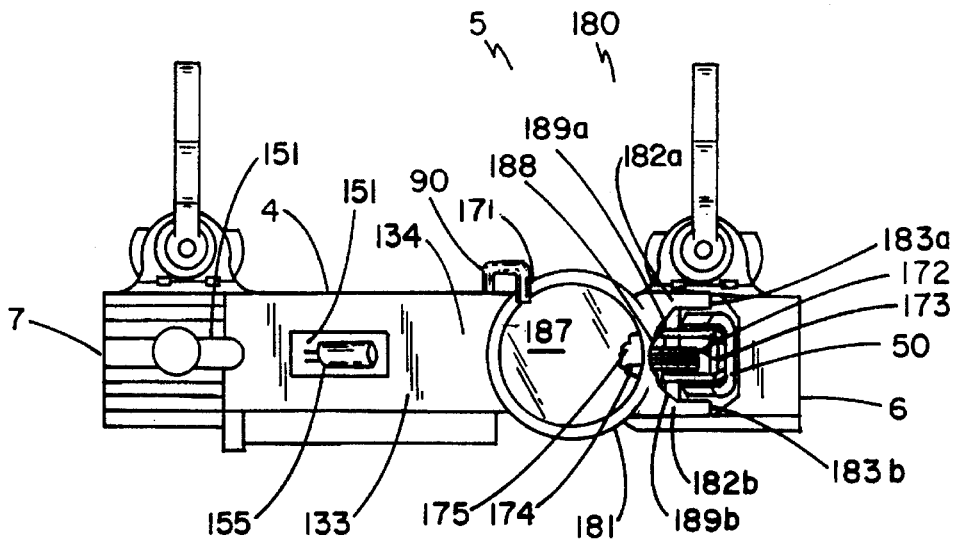
FIG. 19 is a top view of the flip-up optics sight mounted on a buffered attachment device, in the closed position.

FIG. 19 illustrates the detail of the actual flip-up mechanism for the different optics embodiment combinations shown. The resulting self-alignment flip-up optic sight 5 is comprised of the invention base 20, U-shaped alignment member 50 and a modified sight housing 180. The optic sight 5 in one embodiment of the invention is used with an extended rigid frame receiver sleeve 3. The extended rigid frame receiver sleeve 3, itself, is more fully described in Applicant's U.S. Pat. applications Ser. No. 07/859,958, dated Apr. 30, 1992, and Ser. No. 29/010,110, dated Jun. 30, 1993, both of which are incorporated herein by reference.

The optic sight 5 sight housing 180 eliminates the "iron" aiming element 105 and replaces the original sight housing catch plate 81 and adjustment plate 82 with a circular frame 181 joined to two plate like extensions 182*a*, 182*b* corresponding to the original catch plate 81 and adjustment plate 82. Within the circular frame 181 are an aiming optics lens 187 for use in conjunction with a separate illumination means 155 described more fully below. Each plate extension 182*a*, 182*b* terminates in a foot end 183*a*, 183*b*, respectively. The original sight housing upper aperture 84, sight adjustment screw 85, arced spring 86 and aiming element 105 are replaced by the circular frame 181. The sight housing 180 has the same lower aperture 188 as the original 88 and is bounded by the plate extensions 182*a*, 182*b* and alignment surfaces 189*a*, 189*b* (see original alignment surfaces 89*a*, 89*b*).

As with the original embodiment, in the invention open position, the sight housing lower aperture 188 is positioned over the outer faces 55*a* and 55*b* of the U-shaped alignment member 50 such that a rotational spring pin hole 47 in the sight housing 180 shares a common center with the rotational spring pin hole 47 in the alignment plates 51*a* and 51*b* of the U-shaped alignment member 50 and the rotational spring pin hole 47 in the mounting tabs 28*a* and 28*b*. A rotational spring pin 170 is then inserted into the rotational spring pin hole 47 attaching the sight housing 180, U-shaped alignment member 50 and the mounting tabs 28*a* and 28*b* together. The sight housing 180 is attached by the rotational spring pin 170 to the alignment plates 51*a* and 51*b* and the mounting tabs 28*a* and 28*b* such that the sight housing 180 can rotate about the rotational spring pin 170 a predetermined amount. The spring pin 170 affixes the inside faces 54*a* and 54*b* of the U-shaped alignment member 50 adjacent to the outside faces 45*a* and 45*b* of the mounting tabs 28*a* and 28*b* and the inside surfaces of the plate extensions 182*a*, 182*b* to the outer faces 55*a* and 55*b* of the U-shaped member 50. Alternatively, other fasteners such as bolts or rivets could be used.

A finger release clamp 90 identical to the original embodiment holds the sight housing 180 in a the closed position against the base 20. The finger release clamp 90 engages a pin catch slot 171 formed in the circular frame 181 thereby holding the sight housing 180 in a normally closed first position. The finger release clamp 90 is mounted in a pin bore 36 which is drilled into the base rear 26 perpendicular to the longitudinal axis of the sleeve 2.

Rotating the finger release clamp 90 in a rearward direction disengages the finger release clamp 90 from the pin catch slot 171 and allows rotation of the sight housing 180 from the normally closed first position to the open second position. A torsional spring 172 urges the sight housing 180 from the closed first position to a vertical open second position. The torsional spring 172 surrounds the rotational spring pin 170 in the lower aperture 188 area between the foot ends 183*a* and 183*b*. One end 173 of the torsional spring 172 rests in the spring trough 29 and a second end 174 is located in a sight housing spring cavity 175. The spring cavity 175 is located perpendicular to the upper surface of the lower aperture 188. The first 173 and second 174 ends of the torsional spring 170 are located such that the sight housing 180 is urged in a forward direction to the same approximately vertical position around the rotational spring pin 170 when the finger release clamp 90 is disengaged from the pin catch slot 171.

Figure 17:
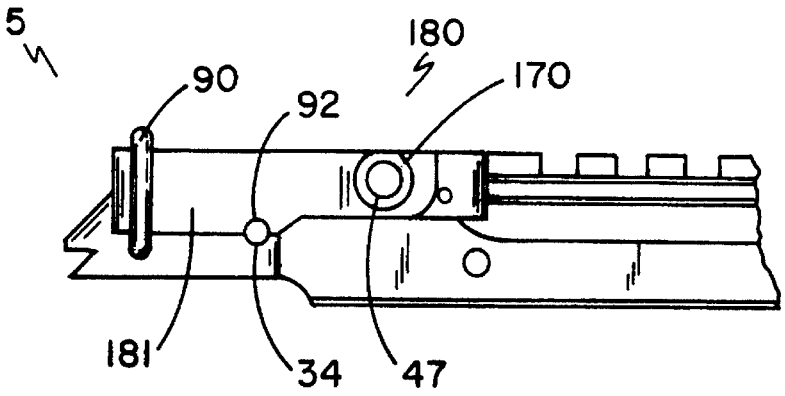
FIG. 17 is a right-side elevational view of the flip-up optics sight in the normally closed first position.
Figure 18:
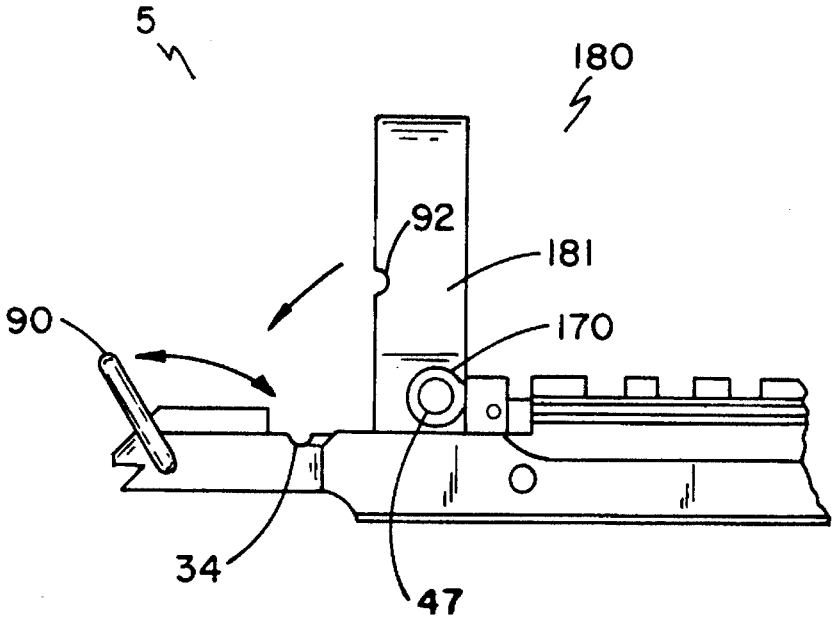
FIG. 18 is a right-side elevational view of the flip-up optics sight in the open second position.

Referring to the drawings in detail wherein like elements are indicated by like numerals, there is shown in FIG. 17 a side elevational view of a self-aligning flip-up optics sight 5 in the normally closed first position. This shows the relative position of the optics sight housing 180 as held in the closed first position by the finger release clamp 90. FIG. 18 illustrates the flip-up optics sight 5 of FIG. 17 with the clamp 90 moved thereby releasing the optics sight housing 180 and allowing it to "flip-up" into an operational position.

Figure 14:
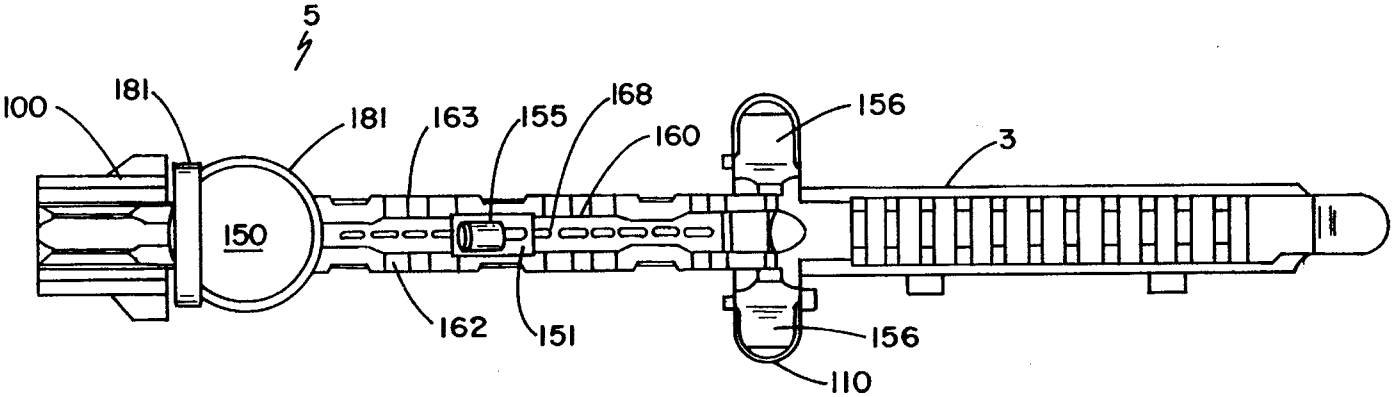
FIG. 14 is a top view of the flip-up optics sight mounted on the extended rigid frame receiver sleeve in the open second position.
Figure 15:
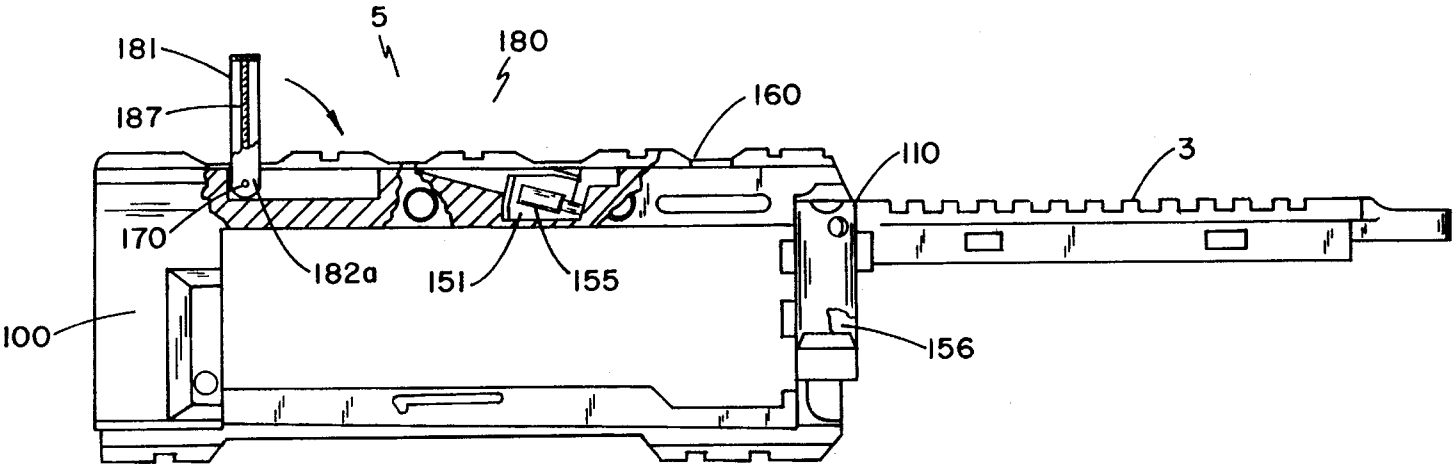
FIG. 15 is a left-side elevational view of the flip-up optics sight shown in FIG. 14.

FIG. 14 and 15 illustrate the use of the self-aligning flip-up optics sight 5 used in conjunction with Applicant's extended rigid frame receiver sleeve 3. The sleeve's forward portion upper sleeve element top section 160 has an open, circular, first cavity 150 formed through the sides rails 162, 163 and into the longitudinal central channel 168. The first cavity 150 is formed just rearward of the sleeve head assembly 100. The first cavity 150 contains the flip-up optics sight 5. A second cavity 151 is formed in the longitudinal central channel 168 rearward of the first cavity 150. The second cavity 151 contains the illumination means 155 used in conjunction with the aiming optics lens 187. The illumination means 155 may be a laser, or other directed energy illuminator which directs energy onto the aiming lens 187. Power is provided top the illumination means 155 by electrical power from batteries 156 mounted in the sleeve yoke 110. Electrical leads (not shown) interconnect the batteries 156 with the illumination means 155.

Figure 16:
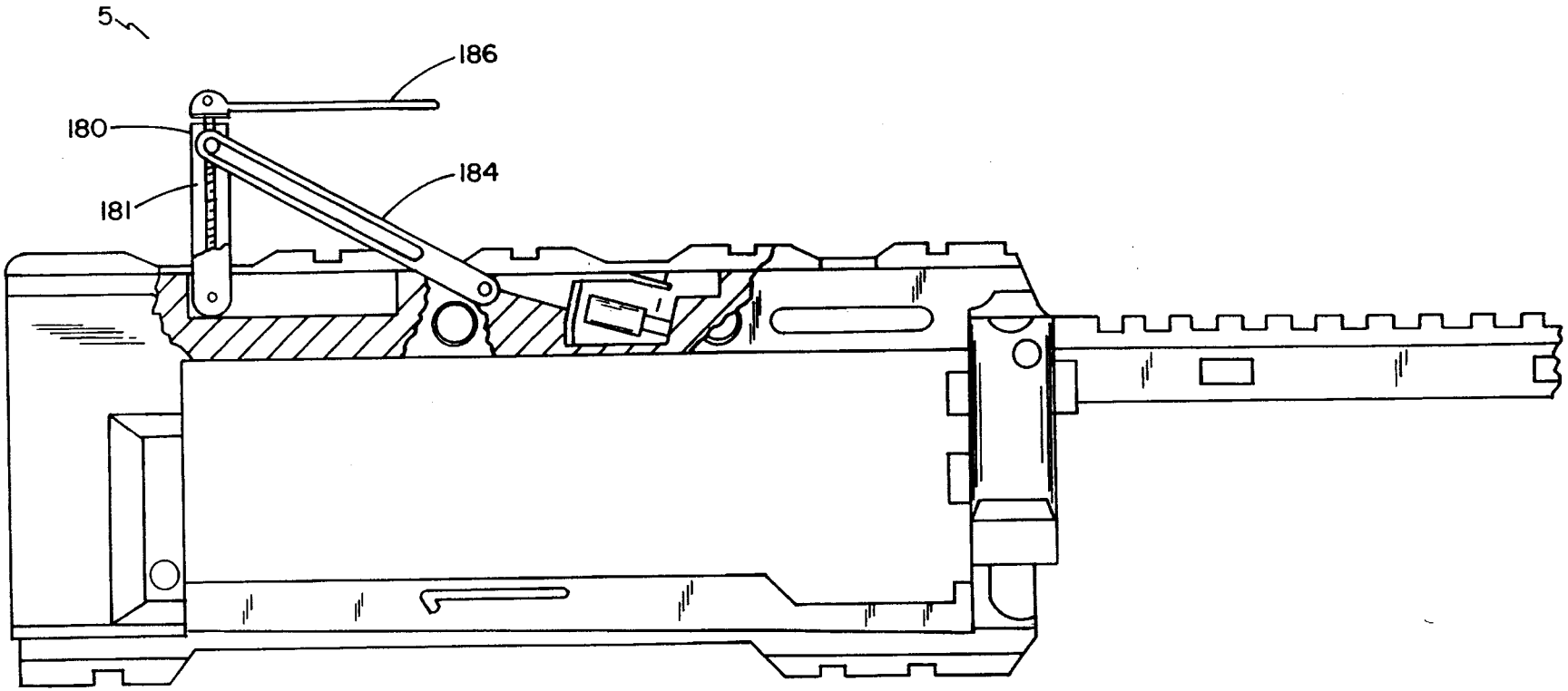
FIG. 16 is a close-up view of enhancements to the flip-up optics sight shown in FIG. 15.

As may be seen in FIG. 16, various modifications may be made to sight housing for ease-of-use in field conditions.

Arms 184 may be added to one or both sides of the circular frame 181 to prevent brush, vines, and the like, from catching onto the lens 187 from the rear and causing damage to the lens 187 or sight housing 180. A cap 186 may also be added to the lens housing 180 for use when the sight 5 is in the fully closed position. The cap 186 is attached to the top 185 of the circular frame 181 and is adapted to fits snugly over the frame 181 and provides protection for the lens 187 from the elements when the sight is in the closed position. When the sight 5 is released to its open, operational position, the cap 186 is adapted to being snapped upward and horizontally rearward from the generally upright frame 181. The cap 186 then acts as a sun shade and provides some protection from falling moisture.

Figure 20:
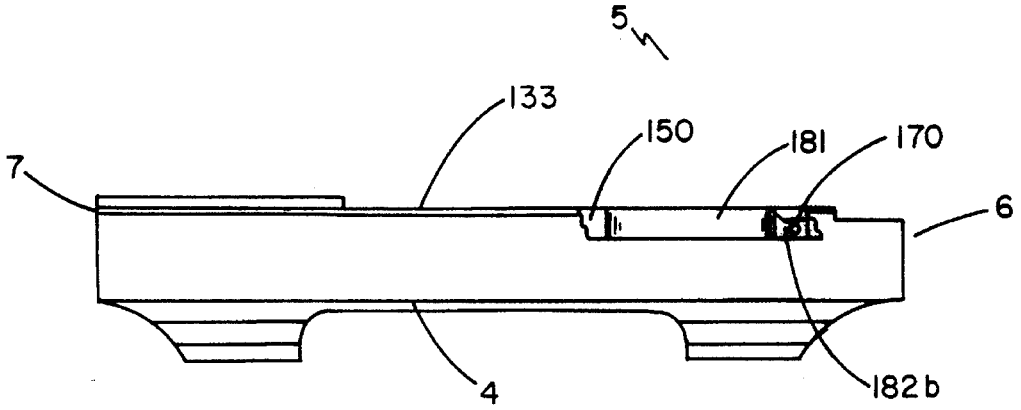
FIG. 20 is a right-side elevational view of the flip-up optics sight shown in FIG. 19.

The principles of the present invention are also applicable to Applicant's attachment device described in U.S. Pat. No. 4,845,871, dated Jul. 11, 1989, and buffered attachment device described in U.S. Pat. No. 5,276,988, dated Jan. 11, 1994, both of which are incorporated herein by reference. FIGS. 19 and 20 illustrate Applicant's buffered attachment device 4 with a self-aligning flip-up optics sight 5 integrated therein. For purposes of illustration, the lens cap 186 and arms 184 have been removed. The device 4 has a forward end 6 and a rearward end 7. The device 4 may be attached to any firearm, including pistols. The longitudinal axis of the device 4 runs between its forward end 6 and its rearward end 7. The longitudinal axis of the device 4 is parallel to and coincident with the longitudinal axis of the firearm to which it is attached. The unique advantage of this embodiment of the invention is that the present invention may be modularly added to an existing weapon without modifying the weapon itself. The attachment device's interface platform 133, a/k/a locking weaver interface, has a central, open, longitudinal channel 134, a/k/a support portion, along its length. The channel 134 contains an open, circular, first cavity 150 formed into and across the top of the platform 133. The first cavity 150 is formed just rearward of the forward end 6 of the attachment device 4. The first cavity 150 contains the flip-up optics sight 5. A second cavity 151 is formed in the platform rearward of the first cavity 150 and just forward of the device rearward end 7. The second cavity 151 contains the illumination means 155 used in conjunction with the aiming optics 187. The illumination means 155 may be a laser, or other directed energy illuminator which directs energy onto the aiming lens 187. Power is provided to the illumination means 155 by electrical power from batteries (not shown). Electrical leads (not shown) interconnect the batteries with the illumination means 155. Power supplies other than batteries may also be utilized in the invention.

It is understood that the above-described embodiments are merely illustrative of the application. Other embodiments may be readily devised by those skilled in the art which will embody the principles of the invention and fall within the spirit and scope thereof.

I claim:

1. A self-aligning flip-up aiming sight attached to a firearm having forward and rearward portions, said firearm having minimally a receiver with a stock and barrel attached thereto, said barrel defining the forward portion of the firearm and said stock defining the rearward portion of the firearm, said firearm longitudinal axis being defined as horizontal and running from said stock through said receiver to said barrel, said receiver being comprised of an upper receiver and a lower receiver, said upper receiver having a forward portion, a top portion and a rearward portion, said barrel being joined to the forward portion of the upper receiver, said sight protruding generally vertically from the firearm when being used and horizontally folded down into the firearm's general contour when not in use, comprising:

a base mounted on the rear of the receiver top portion, said base having a generally flat upper surface, a right side, a left side, front and rear, and two identical, vertical and parallel mounting tabs extending perpendicularly upward from the base upper surface, said tabs having rectangular shapes and lying in vertical parallel planes a predetermined distance apart and parallel to the base sides, said tabs each have a spring pin hole located in a forward lower quadrant with a common center and also a rotational spring pin hole located in a rearward upper quadrant also with a common center, said base front immediately forward, adjacent and between the tabs being raised forming an arc shaped section with a vertical height less than the vertical height of the tabs;

a U-shaped alignment member attached to said base, said U-shaped alignment member having two vertical sides and a front face with a rectangular cutout having a remaining front top portion, each said vertical side having an inner surface, outer surface, rear, front, bottom and top, each said inner surface being defined as a facing surface of each said vertical side, said inner surfaces being in apposition in parallel planes, said vertical sides having a spring pin hole located in a forward lower quadrant with a common center and also a rotational spring pin hole located in a rearward upper quadrant also with a common center, said spring pin holes and rotational spring pin holes being located such that they share common centers with the spring pin and rotational spring pin holes in the mounting tabs, said remaining front top portion of the front cutout positioned nearly on the base front arc-shaped section;

a spring pin inserted through both vertical sides of the U-shaped alignment member and the mounting tabs via the common center spring pin holes, whereby The U-shaped alignment member is attached to the mounting tabs by said spring pin installed through the common spring pin holes;

a sight housing attached to said base, said sight housing having an upper section and a lower section, said upper section having an upper plate arrangement having two sides, a catch side and an adjustment side, and defining an upper aperture containing aiming means, said lower section having two opposing lower plate members positioned in vertical planes and defining a lower aperture, said lower plate members having a rotational spring pin hole formed therein with a common center, said lower aperture further bounded by two alignment surfaces, wherein in the sight protruding position, the sight housing lower aperture is positioned over the outer faces of the U-shaped alignment member such that the rotational spring pin holes in the plates share a common center with the rotational spring pin holes in the alignment plates of the U-shaped alignment member and the rotational spring pin holes in the mounting tabs; and spring means in said sight housing adapted to urge said sight housing in a forward direction from a folded-down horizontal position to a generally upright position.

2. A self-aligning flip-up aiming sight as recited in claim 1, further comprising:

a rotational spring pin inserted through both sight lower plate members, the vertical sides of the U-shaped alignment member and the base mounting tabs via the common center rotational spring pin holes, whereby the sight housing is attached to the U-shaped alignment member and the base mounting tabs, wherein the sight housing is thereby adapted to being rotated about the rotational spring pin a predetermined amount.

3. A self-aligning flip-up aiming sight as recited in claim 2, further comprising:

a chamfer system, comprising:

an alignment chamfer formed on the top of each U-shaped alignment member vertical side, just forward of the rotational spring holes and extending nearly to the said U-shaped alignment member vertical side front, said alignment chamfers beginning at each vertical side innersurface-top edge and sloping downward toward the outersurface-top edge, said chamfers each having a longitudinal axis parallel to the longitudinal axis of the base; and said two sight housing lower aperture alignment surfaces corresponding to said alignment chamfers, whereby in the sight housing generally upright position the alignment surfaces are wedged against the alignment chamfers, respectively, bringing the sight housing to rest in the same vertical position every time it is released.

4. A self-aligning flip-up aiming sight as recited in claim 3, wherein said spring means is comprised of:

a spring trough shaped into the base upper surface between the tabs, the width of the trough being defined by the separation between the mounting tabs, said trough beginning at the base front and extends rearwardly approximately ½ of the base longitudinal distance;

a spring cavity located in the sight housing between the upper and lower apertures, positioned perpendicular to the upper surface of the lower aperture;

said rotational spring pin in the sight housing lower aperture connected to the catch and adjustment lower plate members;

a torsional spring surrounding said rotational spring pin and having two ends, a first end resting in the spring trough and a second end located in said sight housing spring cavity, said torsional spring thereby adapted to being compressed when said sight housing is in a folded-down position;

wherein, said first and second ends of the torsional spring are located such that the sight housing is urged in a forward direction from the folded-down position to the generally upright position.

5. A self-aligning flip-up aiming sight as recited in claim 4, further comprising:

a pin bore drilled into the rear of the base perpendicular to the longitudinal axis of the base;

a finger release clamp mounted in said pin bore;

a pin catch slot formed in the sight housing catch side upper section;

wherein rotation of said clamp in a forward direction causes said finger release clamp to engage said pin catch slot thereby holding said flip-up sight in said folded-down position, and rotating said finger release clamp in a rearward direction disengages the finger release clamp from the pin catch slot and allows said spring means to urge said sight housing in a forward direction from said folded-down position to said generally upright position.

6. A self-aligning flip-up aiming sight as recited in claim 5, wherein:

said upper plate arrangement is comprised of two parallel plates, a catch plate and an adjustment plate, positioned in vertical planes.

7. A self-aligning flip-up aiming sight as recited in claim 6, wherein said upper aperture aiming means is comprised of:

a sight adjustment screw in the sight housing upper aperture between the catch plate and the adjustment plate;

a sight adjustment knob attached to one end of said sight adjustment screw;

an L-shaped aiming element with two ends and a center, said center being mounted on said sight adjustment screw, said element containing a circular aiming peep sight on each end;

an arced spring housed in the sight housing upper aperture, wherein the arced spring allows the aiming element to rotate approximately 90 degrees around the sight adjustment screw;

wherein the aiming element is adapted to be moved across the sight adjustment screw as the sight adjustment knob is turned.

8. A self-aligning flip-up aiming sight as recited in claim 5, wherein:

said upper plate arrangement is comprised of a circular frame having said catch side and said adjustment side, said frame joined to said lower section plate members.

9. A self-aligning flip-up aiming sight as recited in claim 8, further comprising:

aiming optics lens within the circular frame; and illumination means mounted to said receiver rearward of the circular frame and focused on said optics lens.

10. A self-aligning flip-up aiming sight as recited in claim 9, further comprising:

an arm element slidably attached to one side of said circular frame and rotatably connected to said receiver top portion.

11. A self-aligning flip-up optic aiming sight as recited in claim 10, further comprising:

a cap, adapted to fit snugly over said circular frame, attached to the top of said circular frame, said cap adapted to being snapped upward and horizontally rearward from said frame when the sight is released to its generally upright position.

12. A self-aligning flip-up optic aiming sight attached to a firearm having forward and rearward portions, said firearm having minimally a receiver with a stock and barrel attached thereto, said barrel defining the forward portion of the firearm and said stock defining the rearward portion of the firearm, said firearm longitudinal axis being defined as horizontal and running from said stock through said receiver to said barrel, said receiver being comprised of an upper receiver and a lower receiver, said upper receiver having a forward portion, a top portion and a rearward portion, said barrel being joined to the forward portion of the upper receiver, said sight protruding from the firearm when being used and folded down into the firearm's general contour when not in use, comprising:

a base mounted on the receiver top portion, said base having a generally flat upper surface, a right side, a left side, front and rear, and two identical, vertical and parallel mounting tabs extending perpendicularly upward from the base upper surface, said tabs having rectangular shapes and lying in vertical parallel planes a predetermined distance apart and parallel to the base sides, said tabs each have a spring pin hole located in a forward lower quadrant with a common center and also a rotational spring pin hole located in a rearward upper quadrant also with a common center, said base front immediately forward, adjacent and between the tabs being raised forming an arc shaped section with a vertical height less than the vertical height of the tabs;

an alignment member attached to said base, said alignment member having a U-shape, two vertical sides and a front face with a rectangular cutout having a remaining front top portion, each said vertical side having an inner surface, outer surface, rear, front, bottom and top, each said inner surface being defined as a facing surface of each said vertical side, said inner surfaces being in apposition in parallel planes, said vertical sides having a spring pin hole located in a forward lower quadrant with a common center and also a rotational spring pin hole located in a rearward upper quadrant also with a common center, said spring pin holes and rotational spring pin holes being located such that they share common centers with the spring pin and rotational spring pin holes in the mounting tabs, said remaining front top portion of the front cutout positioned nearly on the base front arc-shaped section;

said alignment member being attached to said base by means of a spring pin inserted through both vertical sides of the U-shaped alignment member and the mounting tabs via the common center spring pin holes, whereby the U-shaped alignment member is attached to the mounting tabs by said spring pin installed through the common spring pin holes;

a sight housing pivotally attached to said base and said alignment member, said sight housing having aiming optics lens contained therein, said sight housing having a circular frame joined to two plate like extensions, positioned in vertical planes, each plate extension having a rotational spring pin hole formed therein with a common center, said plate extensions defining a lower aperture, said lower aperture further bounded by two alignment surfaces, wherein in the sight protruding position, the sight housing lower aperture is positioned over the outer faces of the U-shaped alignment member such that the rotational spring pin holes in the plate extensions share a common center with the rotational spring pin holes in the alignment plates of the U-shaped alignment member and the rotational spring pin holes in the mounting tabs, said circular frame containing said optics lens;

spring means in said sight housing adapted to urge said sight housing in a forward direction from a folded-down horizontal position to a generally upright position; and illumination means mounted to said receiver rearward of said sight housing and focused on said optics lens.

13. A self-aligning flip-up optic aiming sight as recited in claim 12, further comprising:

a rotational spring pin inserted through both sight housing plate extensions, the vertical sides of the U-shaped alignment member and the base mounting tabs via the common center rotational spring pin holes, whereby the sight housing is attached to the U-shaped alignment member and the base mounting tabs, wherein the sight housing is thereby adapted to being rotated about the rotational spring pin a predetermined amount.

14. A self-aligning flip-up optic aiming sight as recited in claim 13, further comprising:

a chamfer system, comprising:

an alignment chamfer formed on the top of each U-shaped alignment member vertical side, just forward of the rotational spring holes and extending nearly to the U-shaped alignment member vertical side front, said alignment chamfers beginning at each vertical side innersurface-top edge and sloping downward toward the outersurface-top edge, said chamfers each having a longitudinal axis parallel to the longitudinal axis of the base; and two sight housing alignment surfaces corresponding to said alignment chamfers, whereby when the sight housing is released to the generally upright position, the alignment surfaces are wedged against the alignment chamfers, respectively, bringing the sight housing to rest in approximately the same vertical position every time it is released.

15. A self-aligning flip-up optic aiming sight as recited in claim 14, further comprising:

a pin bore drilled into the rear of the base perpendicular to the longitudinal axis of the base;

a finger release clamp mounted in said pin bore;

a pin catch slot formed in the sight housing circular frame;

wherein rotation of said clamp in a forward direction causes said finger release clamp to engage said pin catch slot thereby holding said flip-up sight in said folded-down position, and rotating said finger release clamp in a rearward direction disengages the finger release clamp from the pin catch slot and allows said spring means to urge said sight housing in a forward direction from a folded-down horizontal position to a generally upright position.

16. A self-aligning flip-up optic aiming sight as recited in claim 15, wherein said spring means is comprised of:

a spring trough shaped into the base upper surface between the tabs, the width of the trough being defined by the separation between the mounting tabs, said trough beginning at the base front and extends rearwardly approximately ½ of the base longitudinal distance;

a spring cavity located in the sight housing above the lower apertures, positioned perpendicular to the upper surface of the lower aperture;

said rotational spring pin in the sight housing lower aperture connected to the catch and adjustment plates;

a torsional spring surrounding said rotational spring pin and having two ends, a first end resting in the spring trough and a second end located in said sight housing spring cavity, said torsional spring thereby adapted to being compressed when said sight housing is in a folded-down position;

wherein, said first and second ends of the torsional spring are located such that the sight housing is urged in a forward direction from the folded-down position to the generally upright position.

17. A self-aligning flip-up aiming sight as recited in claim 16, further comprising:

an arm element slidably attached to one side of said circular frame and rotatably connected to said receiver top portion.

18. A self-aligning flip-up optic aiming sight as recited in claim 17, further comprising:

a cap, adapted to fit snugly over said circular frame, attached to the top of said circular frame, said cap adapted to being snapped upward and horizontally rearward from said frame when the sight is released to its generally upright position.

* * * * *